United States Patent [19]

Kumar et al.

[11] Patent Number: 4,651,126

[45] Date of Patent: Mar. 17, 1987

[54] ELECTRICAL RESISTOR MATERIAL, RESISTOR MADE THEREFROM AND METHOD OF MAKING THE SAME

[76] Inventors: Shailendra Kumar, 250 Beverly Blvd., Upper Darby, Pa. 19082; Gerald Lorenz, 3910 Countrywood La., Hatboro, Pa. 19040; Nellie L. Cabato, 601 Launfall Rd., Plymouth Meeting, Pa. 19462

[21] Appl. No.: 729,830

[22] Filed: May 2, 1985

[51] Int. Cl.[4] ..... H01C 1/012; H01C 17/06; H01B 1/02

[52] U.S. Cl. ..... 338/309; 338/308; 252/512; 252/514; 252/518; 29/620

[58] Field of Search ..... 338/308, 309; 252/512, 252/514, 518, 521; 428/426, 457; 427/101, 123, 427/376, 377, 126.3, 126.5; 29/620, 621

[56] References Cited

U.S. PATENT DOCUMENTS

| | | | |
|---|---|---|---|
| 3,271,193 | 9/1966 | Boykin | 117/227 |
| 3,304,199 | 2/1967 | Faber, Sr. et al. | 117/201 |
| 3,778,389 | 12/1973 | Kasanami et al. | 252/520 |
| 3,876,560 | 4/1975 | Kuo et al. | 252/514 |
| 3,914,514 | 10/1975 | MacKenzie et al. | 428/426 |
| 4,051,074 | 9/1977 | Asada | 252/503 |
| 4,065,743 | 12/1977 | Wahlers et al. | 338/308 |
| 4,175,061 | 11/1979 | Fujimura | 252/518 |
| 4,215,020 | 7/1980 | Wahlers et al. | 252/519 |
| 4,267,074 | 5/1981 | Holmes | 252/514 |
| 4,286,251 | 8/1981 | Howell | 338/309 |
| 4,293,838 | 10/1981 | Wahlers et al. | 338/308 |
| 4,322,477 | 3/1982 | Wahlers et al. | 428/432 |
| 4,340,508 | 7/1982 | Wahlers et al. | 252/520 |
| 4,378,409 | 3/1983 | Wahlers et al. | 428/432 |
| 4,397,915 | 8/1983 | Wahlers et al. | 428/432 |
| 4,561,996 | 12/1985 | Holmes et al. | 427/101 X |

FOREIGN PATENT DOCUMENTS

| | | | |
|---|---|---|---|
| 911629 | 9/1979 | U.S.S.R. | 338/308 |

OTHER PUBLICATIONS

Wu et al., "Low TCR . . . Substrates", *Int. J. Hybrid Micro,* 7:4, pp. 14–22, 12/84.

Strange Temperatures . . . Film Resistor, Electro Comp. Sci. & Tech., 9:205–7, 1982.

*Primary Examiner*—Harold Broome

*Assistant Examiner*—Linda M. Peco

[57] ABSTRACT

An electrical resistor of resistivity of less than about 600 ohms per square and with a temperature coefficient of resistance within the range of ±200 ppm/°C. comprises an insulating substrate, electrically conductive terminations on a surface of the substrate, and a layer of resistor material on the surface of the substrate and in contact with the terminations. The resistor material comprises from about 25 to about 35% by weight glass and from about 50% to about 75% by weight conductive particles. Preferably the conductive particles consisting essential of tin oxide and at least about 0.2% by weight of ruthenium containing material, expressed as $RuO_2$. The mass ratio of ruthenium containing material (as $RuO_2$) to tin oxide is less than 7:93.

40 Claims, 1 Drawing Figure

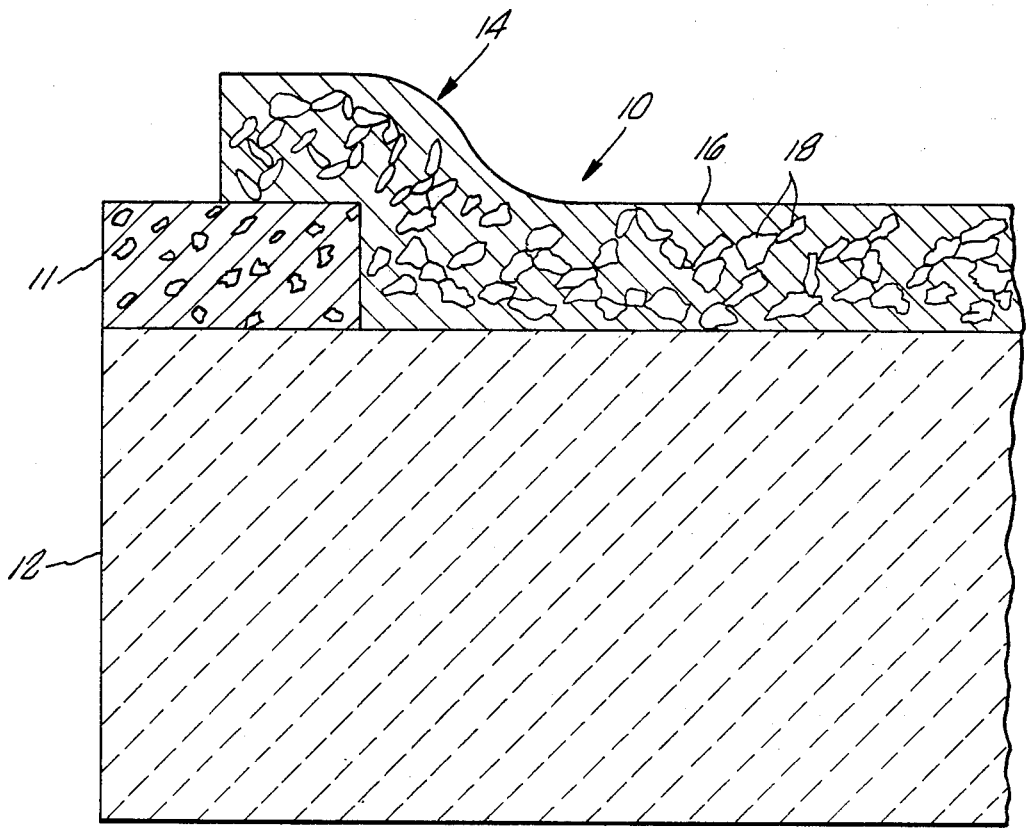
14
10
16
18
11
12

ELECTRICAL RESISTOR MATERIAL, RESISTOR MADE THEREFROM AND METHOD OF MAKING THE SAME

BACKGROUND

This invention relates to a resistor material, resistors made from the resistor material, and a method for making the resistors, and in particular is directed to improvements in tin oxide resistor materials.

Electrical resistor materials comprising a mixture of a glass frit and finely divided particles of tin oxide ($SnO_2$) have achieved significant commercial acceptance. This type of resistor material, a resistor comprising a substrate with fired resistor material on the substrate, and a method for making the material and the resistor are described in U.S. Pat. No. 4,322,477. Resistors made from resistor material comprising glass frit and tin oxide have many desirable features including:

1. A wide range of resistivities from about 700 ohms per square to about 10 megohms per square;
2. High stability with changes in temperature, i.e. a low temperature coefficient of resistance, often within the range of ±200 ppm/°C.;
3. Compatability with commonly used, low cost terminations, such as copper terminations;
4. Low cost, i.e. tin oxide is less expensive than noble metals such as gold, silver, ruthenium, and platinum used in other resistor materials; and
5. Stability under use conditions, i.e. the resistor is generally unaffected by moisture, humidity, static charges, and temperature cycling.

Resistor materials comprising tin oxide and glass frit providing a resistance less than 700 ohms per square are unavailable unless the resistor material is applied in a thickness greater than about 1 mil. However, if the thickness of the resistor material is greater than about 1 mil, problems occur, including (1) difficulty in laser trimming and firing the resistor, (2) low stability with changes in termperature, i.e. a high temperature coefficient of resistance; and (3) thermal mismatch problems between the resistor material and the underlying substrate.

Accordingly there is a need for a resistor material having the advantages of a glass frit/tin oxide resistor material, and that when applied in a thickness of less than about 1 mil is also useful for producing resistors having a resistivity of less than 600 ohms per square.

SUMMARY

The present invention provides a resistor material that satisfies this need. The resistor material is adapted to be applied to and fired on a substrate to form an electrical resistor having a resistivity of less than about 600 ohms per square and a temperature coefficient of resistance within the range of ±200 ppm/°C. The resistor material comprises a mixture of conductive particles and a glass frit. The glass frit is present in an amount of from about 25 to about 35% by weight and the conductive particles are present in an amount of from about 50% to about 75% by weight. The conductive particles comprise tin oxide and a ruthenium containing material in an amount of at least about 0.2% by weight of the conductive particles, expressed as $RuO_2$. All percent by weights and mass ratios presented herein for the ruthenium containing material are based upon expressing the ruthenium in the ruthenium-containing material as ruthenium oxide. It is important that the mass ratio of ruthenium containing material, as $RuO_2$, to tin oxide be less than about 7:93 so that the resistor has a resistivity of less than about 600 ohms per square and a temperature coefficient within the range of ±200 ppm/°C. when the resistor material is present in a thickness of less than about 1 mil.

The ruthenium containing material can be a single ruthenium compound or a mixture of ruthenium compounds. The ruthenium containing material can be ruthenium metal, ruthenium oxide, or both. Preferably the conductive particles consist essentially of tin oxide and the ruthenium containing material.

The resistor material can comprise up to about 20% by weight additives such as an oxidizer for the ruthenium containing material so that upon firing of the resistor material, the ruthenium is present as ruthenium oxide in the resistor material. It has been found that in some instances, the presence of an oxidizer such as an oxide of manganese, improves the stability of a resistor.

In a preferred version, the conductive particles consist of $SnO_2$ and at least 1% by weight ruthenium containing material, with the mass ratio of ruthenium containing material to tin oxide being less than about 3:97.

An electrical resistor can be formed from this resistor material. This is accomplished by mixing together the glass frit, the conductive particles, and the additives, if any, to form the resistor material. The resistor material is then coated on a surface of the substrate and the coated substrate is fired in a substantially non-oxidizing atmosphere to a temperature between about 850° C. and about 1050° C. at which the glass softens but the tin oxide does not melt. The coated substrate is cooled to form a layer of glass bonded to the substrate having the conductive particles dispersed throughout the glass. A preferred electrical resistor prepared according to this method comprises a ceramic substrate, copper terminations on a surface of the substrate, and a layer of the fired resistor material on the surface of the substrate and in contact with the copper termination.

Thus, an electrical resistor according to the present invention has a resistivity of less than about 600 ohms per square, with an excellent temperature coefficent of resistance within ±200 ppm/°C., even with the resistor material being present in a thickness of less than 1.0 mil. Moreover, the resistor has all of the advantages of prior art tin oxide resistors including stability under use conditions, compatability with low cost terminations including copper, and low cost.

DRAWING

These and other features, aspects, and advantages of the present invention will become better understood from the following description, appended claims, and accompanying drawing which is a sectional view of a portion of a resistor according to the present invention.

DESCRIPTION

A vitreous enamel resistor material of the present invention comprises a mixture of vitreous glass frit and conductive particles. The conductive particles comprise tin oxide and a ruthenium containing material.

With reference to the drawing, a resistor 10 prepared from this resistor material comprises a substrate 12 of an electrically insulating material, such as a ceramic, a termination film 11 on a surface of the substrate 12, and a resistance film or layer 14 on a surface of the substrate and contacting the termination film 11. The resistance film 14 comprises glass 16 containing finely divided conductive particles 18 which are embedded in and dispersed throughout the glass 16.

The substrate 12 is generally a body of a ceramic or a glass such as porcelain, steatite, barium titanate, alumina, or the like.

The resistor material comprises:

(1) glass frit in an amount of from about 25 to about 35%, and preferably from about 25 to about 30%, by weight of the resistor material;

(2) conductive particles in an amount of from about 50 to about 75% by weight; and (3) additives in an amount of from 0 to about 20% by weight.

If the resistor material comprises less than about 25% glass particles, the electrical properties of the resistor 10 do not remain substantially constant in use. If the resistor material comprises less than about 50% by weight conductive particles and/or more than about 35% by weight glass, the resistor 10 does not have a resistivity less than about 600 ohms/wquare when the thickness of the resistance film 14 is less than about 1.0 mil.

The glass frit has a softening point below the melting point of the tin oxide particles of the conductive material. A borosilicate frit is preferred, and particularly an alkaline earth borosilicate frit such as a barium or calcium borosilicate frit. The preparation of such frits is well known and comprises, for example, of melting together the constituents of the glass in the form of oxides of the constituents, and pouring the molten composition into water to form the frit. The batch ingredients can be any compound that yields the desired oxides under the conditions of frit production. For example, boric oxide can be obtained from boric acid, silicon dioxide can be produced from flint, and barium oxide can be produced from barium carbonate. The coarse frit is preferably milled in a ball mill with water to reduce the particle size of the frit and to obtain a frit of substantially uniform size.

The conductive particles comprise, and preferably consist essentially of, tin oxide and ruthenium containing material. The conductive particles comprise at least 0.2% by weight ruthenium containing material to produce a resistor having a resistivity less than about 600 ohms per square. The mass ratio of ruthenium containing material to tin oxide must be less than about 7:93 to obtain a resistor having a resistivity less than about 600 ohms per square and a temperature coefficient of resistance within the range of ±200 ppm/°C. Example 3 below demonstrates the importance of limiting the amount of ruthenium containing material in the resistor material.

All percentages by weight of ruthenium containing material presented herein are based on the total weight of the conductive particles 18 in the resistor material 14. Further, the amount of ruthenium containing material is always expressed as if the ruthenium containing material were present in the of $RuO_2$. As described below, it is possible to form a resistor material using ruthenium containing material in a form other than $RuO_2$. Nevertheless, all percentages and mass ratios presented herein are expressed as if the ruthenium containing material were present in the form of $RuO_2$.

Preferably the conductive particles 18 comprise at least about 1% by weight ruthenium containing material and up to about 3% by weight ruthenium containing material. In the case of a resistor material where the conductive particles consist essentially of tin oxide and ruthenium containing material, the mass ratio of tin oxide to ruthenium containing material in the preferred version is from about 99:1 to about 97:3. In this preferred range, the resistor 10 has a resistivity of less than 500 ohms per square and a temperature coefficient of resistance in the range of ±150 ppm/°C. even when the thickness of the resistance film 14 is less than about 1 mil. It is desirable to maintain a small amount of ruthenium containing material because ruthenium containing material is substantially more expensive than tin oxide.

The ruthenium containing material can be included in the resistor material as ruthenium metal, ruthenium oxide, ruthenium resinate, other ruthenium compounds, and combinations thereof. Ruthenium resinate is an organic complex that contains ruthenium and is available from Englehard Chemical Company of East Newark, N.J. under Catalog No. A2575.

The resistor material can include up to 20% by weight additives such as compounds of manganese such as $MnO_2$ and manganese resinate, $Pr_6O_{11}$, $Co_3O_4$, NiO, ZnO, $Ta_2O_5$, niobium oxide, tungsten trioxide, and nickel oxide. These additives can be used in an amount of from about 1 to about 20% by volume of the total volume of the resistor material. In some instances, it has been found that $MnO_2$ and Mn resinate in an amount of from about 0.5 to about 3% by weight of the resistor material improve the thermal stability of the resistor 10 when the resistor is subjected to load stability tests at 150° C. The resistor can include at least 0.1% manganese oxide. Manganese resinate is an organic complex containing manganese available from Englehard Chemical Company under Catalog No. 55A.

The termination 14 can be a noble metal such as silver or gold, but preferably comprises an inexpensive metal such as copper. An advantage of the present invention is the ability to produce resistors having low resistivities from inexpensive components, including copper terminations.

To produce the resistor 10, copper terminations 14 are screened onto the base 12 and fired at an elevated temperature in a substantially non-oxidizing atmosphere. The term "non-oxidizing" atmosphere means an atmosphere that is substantially free of oxygen such as an atmosphere containing nitrogen, argon, and/or helium. Preferably nitrogen is used for its low cost. The firing of the electrode can occur at 1,000° C.

After the glass frit has been prepared by ball milling the glass frit for about 72 hours with water, the glass is dried and combined with the remaining constituents of the resistor material. Mixing preferably is carried out by ball milling the ingredients in water or in an organic medium, such as butyl carbitol acetate or a mixture of butyl carbitol acetate and toluol. The mixture is then adjusted to the proper viscosity for the desired manner of applying the resistor material to the substrate 12 by either adding or removing the liquid medium of the mixture. For screen stencil application, the liquid can be evaporated and the mixture can then be blended with a vehicle comprising ethyl cellulose, an ester alcohol, and an organic wetting agent.

As described in U.S. Pat. No. 4,215,020, the conductive particles can be preheated before mixing with the additives in the glass frit to form the resistor material.

The resistor material is screened onto the surface of the substrate in a uniform thickness. Preferably the thickness of the resistance film 14 is from about 0.5 to about 1.0 mil. Films less than about 0.5 mil in thickness result in resistors having inconsistent resistances. Films greater than about 1 mil in thickness are difficult to manufacture and increase the cost of the resistor 10.

Other techniques besides screening can be used for applying the resistive film 14 to the substrate 12. These include application of the resistor material by brushing, dipping, or spraying.

After the resistor material is applied, it can be dried at low temperature, such as 125° C. for 10 minutes. The substrate 12 with the resistor material 14 thereon can be fired in a conventional furnace at a temperature at which the glass frit become molten, such as from about 850° to about 1050° C. If desired, a small amount of oxygen, in the order of about 5 ppm, can be included in the firing atmosphere so that a portion of the copper, in the order of from 1 to 4% by weight, is in the form of copper oxide to improve adhesion to the ceramic substrate 12. When the substrate and the resistor material are cooled, the glass hardens to bond the resistor material to the substrate.

If desired, a glass glaze (not shown) can be placed over the resistor material 14 for environmental protection.

The following examples illustrate preferred details of the present invention.

EXAMPLE 1

A resistor was prepared using the paste formulation of Table 1A. The paste was prepared from the powder formulation shown in Table 1B which includes a glass component. The glass component formulation is shown in Table 1C.

The glass was initially ball milled with water for 72 hours and then dried. The components of the powder were then milled for three days in the presence of butyl carbitol acetate as a wetting agent. Milling occurred in a ceramic ball mill with $Al_2O_3$ balls. The powder was then dried at 110° to 130° C. in a vacuum and formed into the paste of Table 1A in a three roll mill. A ceramic substrate with copper terminations was then silk screened with the paste formulation and then fired at 1,000° C. in a nitrogen atmosphere containing about 5 ppm oxygen for ½ hour. The resulting resistance film had a thickness of about 0.9 mil.

The following properties of the resistor were determined:

1. Resistance in ohms per square.

TABLE 1A

| Paste 1 Formulation | |
|---|---|
| Component | Weight % |
| Powder 1 (see Table 1B) | 79.45 |
| Tergitol TM TMN-3[1] | 0.42 |
| Vehicle[2] | 18.68 |
| Mn Resinate | 1.45 |

[1]Wetting agent available from Union Carbide Corp. of New York, New York.
[2]98% by weight 2,2,4-trimethylpentanediol-1,3-monoisobutyrate and 2% by weight ethyl cellulose (Hercules Inc., Wilmington, Delaware, Catalog No. K5000).

TABLE 1B

| Powder 1 Formulation | |
|---|---|
| Component | Weight % |
| $SnO_2$* | 69.88 |
| Glass 1 (see Table 1C) | 26.70 |
| $RuO_2$ | 1.46 |
| $MnO_2$ | 1.46 |
| $Ta_2O_5$ | 0.50 |

*Harshaw Chemical, Cleveland, Ohio, can be 50/50 blend of Catalog Nos. 101 and 105

TABLE 1C

| Glass 1 Formulation | |
|---|---|
| Component | Weight % |
| BaO | 32.7 |
| $SiO_2$ | 26.5 |
| $B_2O_3$ | 18.6 |
| $Co_3O_4$ | 13.4 |
| ZnO | 8.8 |

2. Temperature coefficient of resistance. This was determined by placing a resistor unit in a temperature chamber with contact leads out of the chamber for resistance measurements. The temperature of the chamber was varied and resistance measurements were made at −55° C., 25° C., and 125° C. The hot (HTCR) and cold (CTCR) temperature coefficient of resistances were calculated as follows:

$$HTCR(\text{ppm/°C.})=[(R_{125}-R_{25})\times 10^6]/(125-25)$$

$$CTCR(\text{ppm/°C.})=[(R_{25}-R_{-55})\times 10^6]/(25+55)$$

where $R_{125}$=resistance measured at 125° C.,
$R_{25}$=resistance measured at 25° C. and
$R_{-55}$=resistance measured at −55° C.

3. Pulse test—The resistor was tested for a resistance change resulting from a 1 KV pulse. The pulse was created by charging a 240 PF capacitor to 1 KV and then discharging the capacitor through the resistor. The percent change of the original resistance was measured.
4. Thermal shock—The resistor was cycled five times between −55° C. and 150° C. and the change in resistance was measured after the cycling. The percent change of the original resistance was calculated.
5. No Load Storage Stability—The resistor was stored at 150° C. for 408 hours and the percent change of the original resistance was calculated.
6. Load Life at 70° C.—The resistor was subjected to 8.4 volts (equivalent to 8 watts power) while stored at 70° C. for 108 hours. The percent change of the original resistance was calculated.

Typical properties of resistors prepared from the resistor material of this Example are:

| Property | Value |
|---|---|
| Resistivity | 437 ohms per square |
| HTCR | −4 ppm/°C. |
| CTCR | −56 ppm/°C. |
| Pulse Test | −0.02% change in resistance |
| Thermal shock | 0.03% change in resistance |
| No load storage at 150° C. | 0.48% change in resistance |
| Load life at 70° C. | 0.24% change in resistance |

EXAMPLE 2

This example shows the properties of a resistance material according to the present invention where the resistance material contains ruthenium rather than ruthenium oxide. The same method was used for this Example as was used for Example 1 for producing resistors. The formulation of the resistance material is presented in Table 2A with the powder formulation used for the resistance material of Table 2A presented in Table 2B.

TABLE 2A

| Paste 2 Formulation | |
|---|---|
| Component | Weight % |
| Powder 2 (see Table 2B) | 79.45 |
| Tergitol TM TMN-3 | 0.42 |
| Vehicle (same as for paste 1) | 18.68 |
| Mn Resinate | 1.45 |

TABLE 2B

| Powder 2 Formulation | |
|---|---|
| Component | Weight % |
| $SnO_2$* | 70.62 |
| $Ta_2O_5$ | 0.49 |
| Glass 1 (see Table 1C) | 26.42 |
| Ru | 2.47 (Equivalent to 3.25% $RuO_2$) |

*Harshaw Chemical can be 50/50 blend of Catalog Nos. 101 and 105

Typical properties of resistors prepared from the resistor material of this Example are:

| Property | Value |
|---|---|
| Resistivity | 336 ohm/square |
| HTCR | 68 ppm/°C. |
| CTCR | −52 ppm/°C. |
| Pulse Test | −0.015% change in resistance |
| No load storage at 150° C. | 0.95% change in resistance (for 115 hours) |

EXAMPLE 3

Varying the amount of ruthenium in a resistor material has an effect on the resistivity and temperature coefficient of resistance of a resistor made with the material. This Example demonstrates this effect.

Using the same method as used for preparing the resistors of Example 1, resistors were prepared using the powder formulation shown in Table 3. The amount of $RuO_2$ in the powder was varied so that the percent by weight of $RuO_2$ ranged from 0% to 8% by weight, based upon the weight of the conductive particles, i.e. $SnO_2$ and $RuO_2$. For example, to produce a powder containing 5% by weight $RuO_2$, the powder 3 formulation contained 7.28 grams of $RuO_2$; 7.28 grams is 5% of 145.60 grams which is the total weight of tin oxide and the $RuO_2$. Resistors were prepared having thicknesses ranging from about 0.6 to about 1.0 mil.

Table 4 presents the results of the tests. From the results, the importance of maintaining the ruthenium content of the resistance material below 7% by weight is readily apparent. As shown in Table 4, increasing the ruthenium content from 6% to 7% by weight resulted in about a ten-fold increase in resistance, and about a ten-fold increase in the temperature coefficient of resistance, both hot and cold.

Advantages of resistance materials of the present invention and resistors made therefrom are many. The resistors are inexpensive due to the use of non-noble materials such as tin oxide and copper terminations. Further, the only noble component, ruthenium, is used in small amounts. The resistors, even with a resistance material film thickness of less than 1.0 mil, have low resistivities of less than 600 ohms per square, and the resistivities can be less than 500 ohms per square. The temperature coefficient of resistance is within a narrow range, ±200 ppm/°C., and can be within the range of ±150 ppm/°C., and even ±100 ppm/°C. The resistor material is compatible with inexpensive, non-noble terminations such as copper. The resistors are highly stable, under no load aging, loaded aging, temperature cycling, and when subjected to 1 kV pulses.

Although the present invention has been described in considerable detail with reference to certain preferred versions thereof, other versions are possible. Therefore the spirit and scope of the appended claims should not be limited to the description of the preferred versions contained herein.

TABLE 3

| Powder 3 Formulation | |
|---|---|
| Component | Weight (grams) |
| $SnO_2$ | 138.32 |
| $Ta_2O_5$ | 1.00 |
| Glass 1 (see Table 1C) | 53.40 |
| $RuO_2$ | Variable |

TABLE 4

| Test | $RuO_2$ Wt. % | Film Thickness (mils) | Resistivity (ohms/square) | CTCR (−55° C.) (ppm/°C.) | HTCR (125° C.) (ppm/°C.) |
|---|---|---|---|---|---|
| 3A-1 | 0 | 0.9–1.0 | 630 | 5 | 45 |
| 3A-2 | 2 | 0.9–1.0 | 420 | 30 | 110 |
| 3A-3 | 3 | 0.9–1.0 | 375 | −10 | 80 |
| 3A-4 | 4 | 0.9–1.0 | 330 | −45 | 65 |
| 3A-5 | 5 | 0.9–1.0 | 280 | −55 | 55 |
| 3B-1 | 5 | 0.7–0.9 | 354 | −266 | −163 |
| 3B-2 | 6 | 0.7–0.9 | 335 | −397 | −283 |
| 3B-3 | 7 | 0.7–0.9 | 4643 | −4576 | −2726 |
| 3B-4 | 8 | 0.7–0.9 | 4857 | −3779 | −3004 |
| 3A-6 | 0 | 0.6–0.7 | 930 | 25 | 50 |
| 3A-7 | 2 | 0.6–0.7 | 835 | −110 | −45 |
| 3A-8 | 3 | 0.6–0.7 | 765 | −190 | −110 |
| 3A-9 | 4 | 0.6–0.7 | 690 | −245 | −145 |
| 3A-10 | 5 | 0.6–0.7 | 615 | −300 | −200 |

What is claimed is:

1. An electrical resistor of resistivity of less than 600 ohms per square comprising a substrate, the substrate being electrically insulating, and a layer of resistor material having a thickness of less than about 1.0 mil on a surface of the substrate, the resistor material comprising from about 25 to about 35% by weight glass and from about 50 to about 75% by weight conductive particles, the conductive particles comprising tin oxide and ruthenium containing material in an amount of at least about 0.2% by weight, expressed as $RuO_2$, the mass ratio of ruthenium containing material, as $RuO_2$, to tin oxide being less than about 7:93, the glass having a melting point below the melting point of tin oxide.

2. The resistor of claim 1 having a temperature coefficient of resistance within the range of ±200 ppm/°C.

3. The resistor of claim 2 having a temperature coefficient of resistance within the range of ±150 ppm/°C.

4. The resistor of claim 1 in which the ruthenium containing material comprises $RuO_2$.

5. The resistor of claim 1 in which the ruthenium containing material comprises ruthenium metal.

6. The resistor of claim 5 in which the ruthenium containing material, expressed as $RuO_2$, is present in an amount of at least about 1% by weight of the conductive particles, and the mass ratio of ruthenium containing material, as $RuO_2$, to tin oxide is less than about 3:97.

7. The resistor of claim 6 in which the resistor material includes at least 0.1% by weight manganese oxide.

8. The resistor of claim 1 in which the conductive particles consists essentially of tin oxide and ruthenium containing material.

9. The resistor of claim 8 in which the resistor material includes an oxidizer for the ruthenium containing material.

10. The resistor of claim 9 in which the oxidizer is an oxide of manganese.

11. The resistor of claim 1 including a copper termination on a surface of the substrate, the resistor material being in contact with the copper termination.

12. An electrical resistor of resistivity of less than about 600 ohms per square and with a temperature coefficient of resistance within ±150 ppm/°C., the resistor comprising an insulating substrate, copper terminations on a surface of the substrate, and layer of resistor material having a thickness of less than about 1.0 mil on the surface of the substrate and in contact with the copper terminations, the resistor material comprising at least 0.1% by weight of an oxide of manganese, from about 25 to about 35% by weight glass and from about 50% to about 75% by weight conductive particles, the conductive particles consisting essential of from about 97 to about 99% by weight tin oxide and from about 1% to about 3% by weight ruthenium oxide.

13. A vitreous resistor material capable of being applied to and fired on a substrate in a non-oxidizing atmosphere in a thickness of less than about 1.0 mil to form an electrical resistor with a resistivity of less than about 600 ohms per square and a temperature coefficient of resistance within the range of ±200 ppm/°C., the resistor material comprising a mixture of conductive particles and a glass frit, the glass frit being present in an amount of from about 25% to about 35% by weight and the conductive particles being present in an amount of from about 50 to about 75% by weight, the conductive particles comprising tin oxide and ruthenium containing material in an amount of at least about 0.2% by weight, expressed as $RuO_2$, the mass ratio of ruthenium containing material, as $RuO_2$, to tin oxide being less than about 7:93, the glass frit having a softening point below the melting point of the tin oxide particles.

14. The resistor material of claim 13 wherein the temperature coefficient of resistance is within the range of ±150 ppm/°C.

15. The resistor material of claim 13 in which the ruthenium containing material comprises $RuO_2$.

16. The resistor material of claim 13 in which the ruthenium containing material comprises ruthenium metal.

17. The resistor material of claim 13 in which the conductive particles consist essentially of tin oxide and ruthenium containing material.

18. The resistor material of claim 13 in which the ruthenium containing material, expressed as $RuO_2$, is present in an amount of at least about 1% by weight of the conductive particles, and the mass ratio of ruthenium containing material, $RuO_2$, to tin oxide is less than about 3:97.

19. The resistor material of claim 1 including at least 0.1% by weight manganese oxide.

20. The resistor material of claim 17 including an oxidizer for the ruthenium containing material.

21. The resistor material of claim 20 in which the oxidizer is an oxide of manganese.

22. A vitreous resistor material capable of being applied to and fired on a substrate in a non-oxidizing atmosphere in a thickness of less than about 1.0 mil to form an electrical resistor with a resistivity of less than about 600 ohms per square and with a temperature coefficient of resistance within ±150 ppm/°C., the resistor material comprising at least 0.1% by weight of an oxide of manganese, from about 25 to about 35% by weight glass frit and from about 50% to about 75% by weight conductive particles, the conductive particles consisting essentially of from about 97 to about 99% by weight tin oxide and from about 1% to about 3% by weight ruthenium oxide, the glass frit having a melting point below the melting point of tin oxide.

23. A method of preparing an electrical resistor providing a resistivity of less than 600 ohms per square comprising the steps of:

(a) coating a surface of an electrically insulating substrate with a mixture comprising from about 25 to about 35% by weight glass frit and from about 50 to about 75% by weight conductive particles, the conductive particles comprising tin oxide and ruthenium containing material, the ruthenium containing material, expressed as $RuO_2$, being present in an amount of at at least about 0.2% by weight of the conductive particles, the mass ratio of the ruthenium containing material, as $RuO_2$, to tin oxide being less than about 7:93, wherein the mixture is coated onto the substrate in a thickness of less than about 1.0 mil;

(b) firing the coated substrate in a substantially non-oxidizing atmosphere to a temperature between about 850° C. and about 1050° C. at which the glass frit softens but the tin oxide does not melt; and (c) cooling the coated substrate to form a layer of glass bonded to the substrate and having the conductive particles dispersed throughout the glass, wherein the electrical resistor has a resistivity of less than about 600 ohms per square.

24. The method of claim 23 where the electrical resistor has a temperature coefficient of resistance within the range of ±200 ppm/°C.

25. The method of claim 24 where the electrical resistor has a temperature coefficient of resistance within the range of ±150 ppm/°C.

26. The method of claim 23 in which the ruthenium containing material comprises $RuO_2$.

27. The method of claim 23 in which the ruthenium containing material comprises ruthenium metal.

28. The method of claim 23 in which the conductive particles consist essentially of tin oxide and ruthenium containing material.

29. The method of claim 28 in which the resistor material includes at least 0.1% by weight manganese oxide.

30. The method of claim 23 in which the ruthenium containing material, expressed as $RuO_2$, is present in an amount of at least about 1% by weight of the conductive particles, and the mass ratio of ruthenium containing material, as $RuO_2$, to tin oxide is less than about 3:97.

31. The method of claim 23 including an oxidizer for the ruthenium containing material.

32. The method of claim 31 in which the oxidizer is an oxide of manganese.

33. The method of claim 23 wherein the substrate has at least one copper termination thereon and the coating layer of glass is in contact with the copper termination.

34. A method for preparing an electrical resistor providing a resistivity of less than about 600 ohms per square and a temperature coefficient of resistance within ±150 ppm/°C. comprising the steps of:

(a) placing termination comprising copper on an electrically insulating substrate;

(b) coating a surface of the substrate with a mixture comprising from about 25 to about 35% by weight glass frit, from about 50 to about 75% by weight conductive particles, and at least 0.1% by weight of an oxide of manganese, the conductive particles consisting essentially of from about 97 to about 99% by weight tin oxide and from about 1% to about 3% by weight ruthenium oxide, the mixture being in contact with the terminations and being applied in a thickness of less than about 1.0 mil;

(c) firing the coated substrate in a substantially non-oxidizing atmosphere to a temperature between about 350° and about 1050° C. at which the glass frit softens but the tin oxide does not melt; and (d) cooling the coated substrate to form a layer of glass bonded to the substrate and having the conductive particles dispersed throughout the glass, wherein the electrical resistor has a resistivity of less than about 600 ohms per square and a temperature coefficient of resistance within ±150 ppm/°C.

35. An electrical resistor of resistivity of less than 600 ohms per square comprising a substrate, the substrate being electrically insulating, and a layer of resistor material on a surface of the substrate, the resistor material comprising from about 25 to about 35% by weight glass and from about 50 to about 75% by weight conductive particles, the conductive particles consisting essentially of tin oxide and ruthenium containing material in an amount of at least about 0.2% by weight, expressed as $RuO_2$, the mass ratio of ruthenium containing material, as $RuO_2$, to tin oxide being less than about 7:93, the glass having a melting point below the melting point of tin oxide.

36. The resistor of claim 35 having a temperature coefficient of resistance within the range of ±200 ppm/°C.

37. The resistor of claim 35 having a temperature coefficient of resistance within the range of ±150 ppm/°C.

38. A vitreous resistor material capable of being applied to and fired on a substrate in a non-oxidizing atmosphere in a thickness of less than about 1.0 mil to form an electrical resistor with a resistivity of less than about 600 ohms per square, the resistor material comprising a mixture of conductive particles and a glass frit, the glass frit being present in an amount of from about 25% to about 35% by weight and the conductive particles being present in an amount of from about 50 to about 75% by weight, the conductive particles consisting essentially of tin oxide and ruthenium containing material in an amount of at least about 0.2% by weight, expressed as $RuO_2$, the mass ratio of ruthenium containing material, as $RuO_2$, to tin oxide being less than about 7:93, the glass frit having a softening point below the melting point of the tin oxide particles.

39. The resistor material of claim 38 wherein the elctrical resistor has a temperature coefficient of resistance within the range of ±200 ppm/°C.

40. The resistor material of claim 38 wherein the electrical resistor has a temperature coefficient of resistance within the range of ±150 ppm/°C.

* * * * *